US005855476A

United States Patent [19]

Gottschalk

[11] Patent Number: 5,855,476

[45] Date of Patent: Jan. 5, 1999

[54] DEVICE FOR HEAT TREATMENT OF CONTINUOUS MATERIAL WEBS

[75] Inventor: Karl-Heinz Gottschalk, Hamburg, Germany

[73] Assignee: Babcock Textilmaschinen GmbH, Seevetal, Germany

[21] Appl. No.: 763,305

[22] Filed: Dec. 10, 1996

[30] Foreign Application Priority Data

Dec. 12, 1995 [DE] Germany ..... 195 46 344.7

[51] Int. Cl.[6] ..... F27B 9/28

[52] U.S. Cl. ..... 432/59; 34/638

[58] Field of Search ..... 432/8, 59; 34/634, 34/636, 638

[56] References Cited

U.S. PATENT DOCUMENTS

| | | | |
|---|---|---|---|
| 3,739,483 | 6/1973 | Meier-Windhorst | 34/618 |
| 4,697,354 | 10/1987 | Gottschalk | 34/446 |
| 4,952,145 | 8/1990 | Kwiatkowski et al. | 432/59 |
| 5,191,725 | 3/1993 | Wohlgenannt et al. | 34/635 |
| 5,333,395 | 8/1994 | Bulcsu | 34/644 |

FOREIGN PATENT DOCUMENTS

3511950A1 10/1986 Germany .

OTHER PUBLICATIONS

Kroell, Trockner und . . . pp. 37, 103, 177, 1959.

*Primary Examiner*—Teresa J. Walberg
*Assistant Examiner*—Gregory Wilson
*Attorney, Agent, or Firm*—Michael J. Striker

[57] ABSTRACT

A device for heat treatment of continuous material webs with hot steam has a substantially sealed housing having at least one chamber, a blower having a shaft, a drive arranged outside of the housing and connected with the shaft with the blower, a heater provided with conduit for supplying gaseous or liquid substances, nozzles with nozzle openings facing toward a material web to be heat treated, an element for transporting the material to be treated through the housing, the housing having a bottom, the shaft and the conduits extending through the bottom of the housing.

6 Claims, 2 Drawing Sheets

DEVICE FOR HEAT TREATMENT OF CONTINUOUS MATERIAL WEBS

BACKGROUND OF THE INVENTION

The present invention relates to a device for heat treatment of continuous material webs by blowing of hot steam.

A drying in pure hot steam is very efficient, since it is not necessary to heat any air coming from outside. This is described in the book "*Drying and drying processes*" of K. Kroll, Springer-verlag 1959, page 37. Additional factors also contribute to the efficiency of this matter, such as the fact that waste air cleaning is dispensed with since no waste is produced. The latent heat contained in the waste steam can be recovered relatively simple by condensation. Because of the low density of the steam, the consumption of electrical energy for recirculation of the drying medium is approximately ⅓ lower than in driers operating with hot air. A further advantage which is especially important for drying textiles is described in the above mentioned book on page 177. The heat steam drying improves the material web, imparts a good feel to it, and allows the colors to appear fresh and clear. The hot steam drying can be provided not only for material webs of natural fibers, but also for such material webs which are produced from synthetic fibers. They can be treated with temperatures of 100–300° C.

The German document DE 35 11 950 discloses a heat steam dryer, from which the present invention is derived. The material web is brought for example by tensioning chains through a slot formed in the bottom of the housing, and can be guided in and out of the housing through the slot. The slot is provided with special seals.

As disclosed in the above mentioned book on page 103, it is not very simple in the practice to form a heat steam dryer for a continuous operation, for example for fabric webs, so tight that no air can penetrate into it. The problems arise not only with the slot for the material web-guiding tensioning chain, but also for example for conduits which extend through the housing wall, doors, or passages for a sieve.

SUMMARY OF THE INVENTION

Accordingly, it is an object of present invention to provide a device for heat treatment of continuous material webs, which avoids the disadvantages of the prior art.

In keeping with these objects and with others which will become apparent hereinafter, one feature of the present invention resides, briefly stated, in a device for heat treatment of continuous material webs, in which a shaft and conduits extend through a bottom of the housing.

When the device is designed in accordance with the present invention, it is formed with simple means so that the penetration of air is substantially suppressed. In the hot steam dryer in accordance with the present invention, the critical points where leakage flow can occur are located in the bottom of the housing. The remaining walls are free from any open passages.

In accordance with a further features of the present invention, the housing can have several successive chambers. A feeding device can be provided with two tensioning chains. At least one conduit for blowing saw steam can pass through the bottom of the housing.

The device can have at least one sieve arranged in a circulating flow and withdrawable through an opening in the bottom. The bottom of the housing can be provided with access windows.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
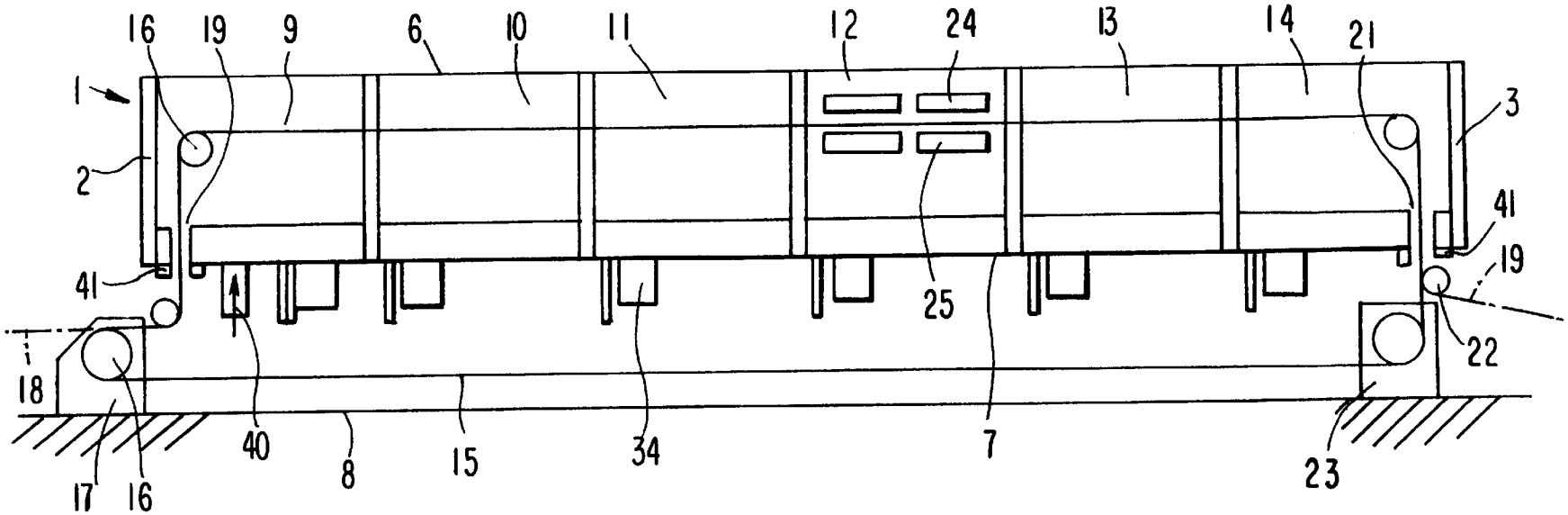
FIG. 1 is a side view of a device for heat treatment of continuous material webs in accordance with the present invention.
Figure 2:
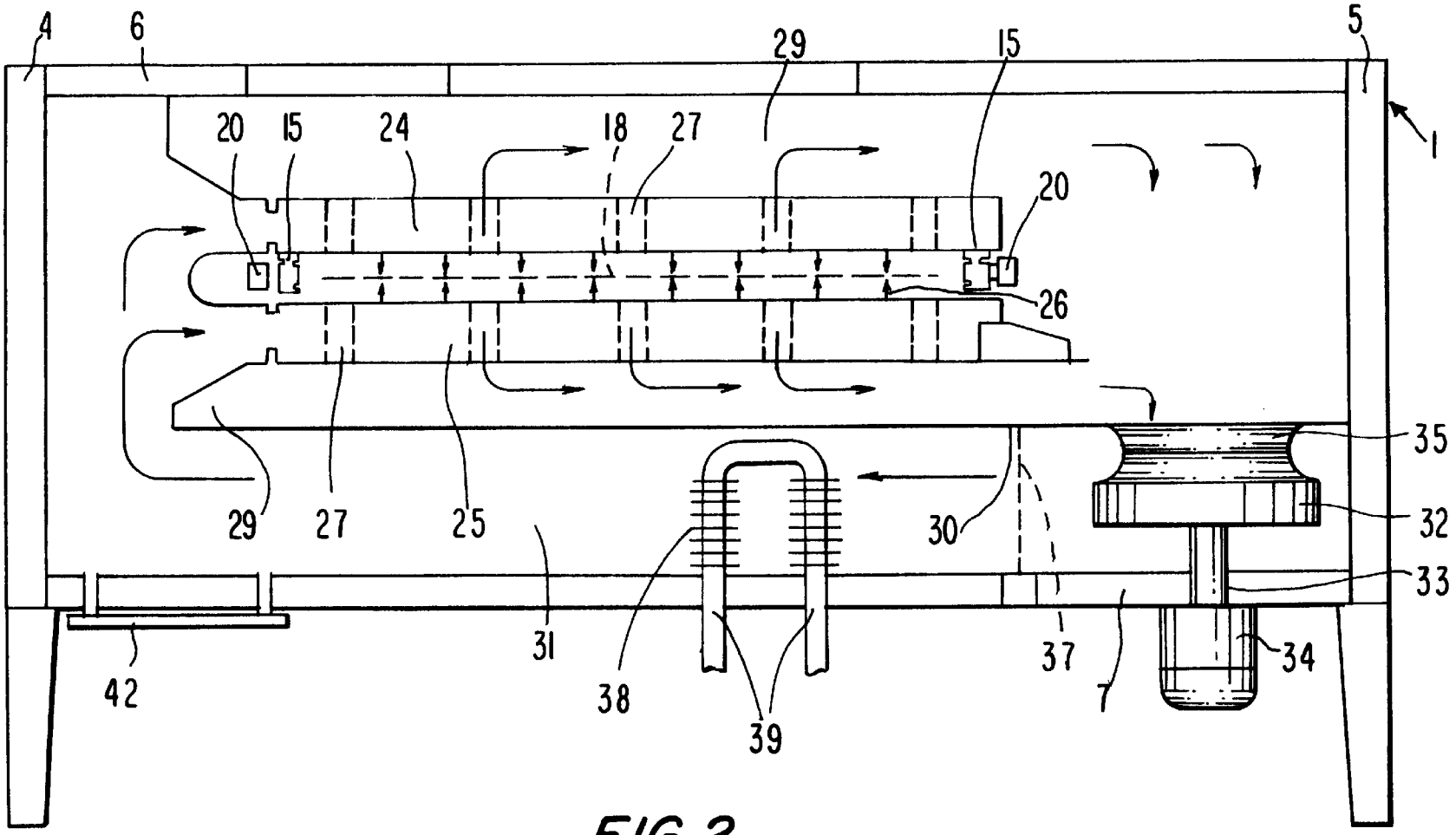
FIG. 2 is a view showing a cross-section of the device in accordance with the present invention shown in FIG. 1.

A device for heat treatment of continuous material webs has a housing which is identified as a whole with reference numeral 1. The housing 1 has end walls 2 and 3, side walls 4 and 5, a cover 6 and a bottom 7. With the exception of the bottom 7, all walls 2–6 are completely free from openings, conduit passages or similar throughgoing passages. The cover 6 is preferably heated to avoid condensation, in particular in a heating stage. The housing is raised vertically, so that a distance is provided between the bottom 7 and a gallery floor 8.

The housing 1 includes a plurality of chambers 9–14 which are assembled with one another in a modular manner. The abutment points of the walls of the neighboring chambers are sealed. All walls are provided with a heat insulation.

Two endless tensioning chains 15 provided with clips and/or needle strips, preferably in lubrication-free construction, are guided in vertical planes over deviating rollers 16. The run of the material-guiding chain runs from an inlet stand 17 to which a material web 18 is supplied, to the tensioning chain 15, perpendicularly upwardly through an inlet slot 19 provided in the bottom 7, so as to be introduced into the chamber 9. The tensioning chains 15 run on chain webs 20 which are displaceable in a transverse direction for adjusting to the width of the material web 18. They run in the housing 1 in the longitudinal direction and then are guided from the end chamber 14 perpendicularly downwardly through an outlet slot 21 of the bottom 7. After releasing the treated, in particular dried product web 18 which is pulled over a roller 22, the empty run of the chain runs from an outlet stand 23 under the bottom 7 of the housing 1 back to the inlet stand 17.

Separating walls are provided between individual chambers 9–14. Each separating wall has a throughgoing opening for the material web 18, the tensioning chain 15, and the chain webs 20.

Nozzle boxes 24 and 25 are arranged above and below the product web 18 in the chambers 9–14, which in FIG. 1 is shown only for the chamber 12 for better illustration. At the side which faces the product web 18 they are provided with nozzle openings for blowing steam onto the product web 18 as identified with arrows 26. Return flow passages 27 pass through each nozzle box 24, 25. They have a greater cross-section than the nozzle openings 26 and extend from the lower side to the upper side of the nozzle box 24, 25.

Each nozzle box 24, 25 at an inflow side is in open communication with a vertical shaft 28 which is limited by the side wall 4 from outside. The nozzle boxes 24, 25 are surrounded by a collecting chamber 29. The collecting chamber is separated by a horizontal intermediate member 30 from a flow passage 31 which adjoins the bottom 7 and opens into the shaft 28.

A radial blower 32 is arranged near the side wall 5 which is opposite to the shaft 28. The blower 32 is coupled with a drive motor 34 which is arranged under the bottom 7 and has a shaft 33 extending through the bottom 7. The blower 32 at a suction side is in communication with the collecting chamber 29 through a suction funnel 35 which is mounted on the edge of an opening of the intermediate bottom 30. A sieve 37 is arranged after the radial blower 32 in the flow passage 31. It is removable through a slot in the bottom 7, for example for cleaning.

A heat register 38 is arranged in the flow passage 31. It is connected with conduits 39 for supply and withdrawal of a heating medium. The conduits 39 pass through the bottom 7. A conduit 40 extending through the bottom 7 opens into the inlet chamber 9 for blowing-in of steam, for example during pure thermal treatment of dry material webs, or during starting of a dryer. Suction boxes 41 are arranged at both sides of the inlet slot 19 and the outlet slot 21. They have a wall provided with not shown suction openings which face the product web 18. The suction boxes 41 are connected with a device for heat recovery, for example with a condensation device, by not shown tubular conduits.

Access windows 42 are provided in the bottom 7. In some cases, also the bottom 7 is provided with passages for not shown measuring devices, such as pyrometer or moisture measuring devices.

In accordance with another embodiment of the invention, which is not shown in the drawings, instead of the heat register 38, a gas burner as a heater is provided. In this case the conduit for gas and combustion air pass in a corresponding manner through the bottom 7.

For performing a drying operation, the device is supplied in the starting phase with hot steam through the conduit 40 for displacement of the available air. By drying the material web 18, new steam is continuously produced. The steam is circulated by a blower 32 in each individual chamber 9–14 and held at a prescribed temperature by a heat register 38. The steam is blown through the nozzles 26 onto the material web 18 and flows into the collecting chamber 29 through the return flow passages 27 or intermediate spaces between the neighboring nozzle boxes 24 and 25. The steam produces an overpressure in the whole inner space of the housing 1. The overpressure is relatively high in the shaft 28 and in the flow passage 31, or in other words in particular close to the bottom 7, in which the passages of the shaft 33, the conduits 39, 40, the sieve 37, the access windows 42, and other passages are provided.

However, in the regions which communicate at a suction side with the blower 32 a lower overpressure relative to the atmospheric pressure is maintained. Excessive steam escapes through the inlet slot 19 and the outlet slot 21 and is drawn by the suction box 41 and supplied for example to a condensation device for heat recovery. The drawn steam quantity in the continuous operation corresponds exactly to the steam quantity which is driven from the material web 18 during drying.

The device in accordance with the present invention provides for an additional advantage in that, the smooth walls which are free from passages can be produced in a very simple way and therefore especially cost-efficiently.

It will be understood that each of the elements described above, or two or more together, may also find a useful application in other types of constructions differing from the types described above.

While the invention has been illustrated and described as embodied in device for heat treatment of continuous materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for heat treatment of continuous material webs, with hot steam, comprising a substantially sealed housing having at least one chamber; a blower having a shaft; a drive arranged outside of the housing and connected via said shaft with said blower; heating means provided with conduits for supplying gaseous or liquid substances; a plurality of nozzle units provided with nozzle openings facing toward a material web to be heat treated; means for transporting the material to be treated through said housing, said housing having a bottom, said shaft and said conduits extending through said bottom of said housing, said bottom being provided with an inlet slot and an outlet slot for introducing and withdrawing a material web correspondingly; at least one conduit for blowing-in of vapor and extending through said bottom; and a sieve arranged in a circulating flow of stream, said bottom being provided with an opening through which said sieve is removable, said bottom being also provided with an access window.

2. A device as defined in claim 1, wherein said housing has a plurality of such chambers which are arranged one after the other.

3. A device as defined in claim 1, wherein said means for transporting the material web to be treated include two tensioning chains.

4. A device as defined in claim 1, wherein said housing has a side wall limiting a shaft, said nozzle means including nozzle boxes which communicate with said shaft at an inflow side.

5. A device as defined in claim 4, wherein said housing has a flow passage which is located near said bottom and opens into said shaft, and a collecting chamber which is separated from said flow passage by an intermediate bottom and surrounds said nozzle boxes.

6. A device as defined in claim 5, wherein said housing has another side wall on which said blower is arranged, said blower being formed as a radial blower and being connected at a suction side with said collecting chamber through an opening of said intermediate bottom and connected at a pressure side with said flow passage.

* * * * *